US006800997B2

(12) United States Patent
Yamashita et al.

(10) Patent No.: US 6,800,997 B2
(45) Date of Patent: Oct. 5, 2004

(54) COLD-CATHODE FLUORESCENT LAMP

(75) Inventors: Hirofumi Yamashita, Moriguchi (JP); Haruo Yamazaki, Moriyama (JP); Toshihiro Terada, Amagasaki (JP); Shinji Kihara, Maiduru (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 10/106,214

(22) Filed: Mar. 27, 2002

(65) Prior Publication Data

US 2002/0140353 A1 Oct. 3, 2002

(30) Foreign Application Priority Data

Mar. 28, 2001 (JP) ..... 2001-091524

(51) Int. Cl.[7] ..... H01J 61/09

(52) U.S. Cl. ..... 313/618; 313/346 R; 313/620; 313/621; 313/632; 313/574; 313/310; 313/631

(58) Field of Search ..... 313/635, 574, 313/575, 310, 311, 618, 491, 633, 346 R, 345, 355, 634, 620, 621, 631, 632, 283, 331, 326

(56) References Cited

U.S. PATENT DOCUMENTS 5,304,893 A * 4/1994 Nieda ..... 313/631
5,962,977 A * 10/1999 Matsumoto et al. ..... 313/633
5,982,088 A * 11/1999 Hamada et al. ..... 313/491
6,130,511 A * 10/2000 Rothwell et al. ..... 315/246
6,356,019 B1 * 3/2002 Hutcherson et al. ..... 313/631
6,417,607 B1 * 7/2002 Thielen ..... 313/339
6,507,151 B1 * 1/2003 Kraus et al. ..... 313/631

FOREIGN PATENT DOCUMENTS

| | | |
|---|---|---|
| JP | 01151148 A | 6/1989 |
| JP | 4-337239 | 11/1992 |
| JP | 4-337240 | 11/1992 |
| JP | 10-199476 | 7/1998 |
| JP | 11-111217 | 4/1999 |
| JP | 2000-133201 | 5/2000 |

* cited by examiner

*Primary Examiner*—Edward J. Glick
*Assistant Examiner*—Elizabeth Keaney
(74) *Attorney, Agent, or Firm*—Parkhurst & Wendel, L.L.P.

(57) ABSTRACT

The present invention has an object to provide a cold-cathode fluorescent lamp which can suppress sputtering caused by electric discharge and reduce consumption of mercury so as to achieve a longer lifetime even if a lamp current is large and a lighting tube has a small diameter. The cold-cathode fluorescent lamp according to the present invention is characterized in that a distance between the inner surface of the lighting tube and the outer surface of a cylindrical electrode is set such that electric discharge develops mainly on the inner surface of the cylindrical electrode. When the lighting tube has an inside diameter D1 of 1 to 6 mm and the maximum lamp current is 5 mA or more, an outside diameter D2 of the cylinder electrode is preferably set at D1−0.4 [mm]≦D2<D1.

8 Claims, 4 Drawing Sheets

(a)

(b)

COLD-CATHODE FLUORESCENT LAMP

FIELD OF THE INVENTION

The present invention relates to a cold-cathode fluorescent lamp used for backlighting of a liquid crystal display and the like.

BACKGROUND OF THE INVENTION

A cold-cathode fluorescent lamp used as a light source for backlighting of a liquid crystal display is configured such that cylindrical or plate metal is provided as an electrode in a lighting tube, which has phosphor applied onto the inner surface of a glass tube, mercury and the like is contained therein, and the phosphor is excited by ultraviolet radiation, which is generated by electric discharge in the lighting tube, to provide visible radiation.

As to such a cold-cathode fluorescent lamp, a variety of studies on miniaturization, a smaller diameter, higher intensity, and longer lifetime have been conducted in response to diversity of liquid crystal displays. For example, Japanese Patent Laid-Open No. 1-151148 proposes a cold-cathode fluorescent lamp, in which in order to reduce consumption of mercury in a lamp in high-power electric discharge and to optimize a discharging area of an electrode, a cylindrical electrode made of metal is provided on an end of a lighting tube to obtain longer lifetime.

However, in the cold-cathode fluorescent lamp configured thus, when the lamp has a relatively large current of 5 mA or more and the lighting tube has an extremely small inside diameter of 1 to 6 mm, both of the inner surface and outer surface of the cylindrical electrode are subjected to electric discharge. Thus, electrode sputtering materials generated by electric discharge are increased, thereby accelerating a so-called mercury trapping phenomenon, which consumes mercury in the lamp. Consequently, longer lifetime of the cold-cathode fluorescent lamp cannot be achieved.

The present invention has as its object the provision of a cold-cathode fluorescent lamp which can solve the above-mentioned problem. The cold-cathode fluorescent lamp can suppress sputtering caused by electric discharge and reduce consumption of mercury, thereby achieving longer lifetime.

DISCLOSURE OF THE INVENTION

A cold-cathode fluorescent lamp of the present invention comprises a sealed lighting tube having a phosphor applied onto its inner surface, and a cylindrical electrode provided on an end of the lighting tube. The phosphor provided inside the lighting tube is excited by ultraviolet radiation generated inside the lighting tube by electric discharge to provide visible radiation. The cold-cathode fluorescent lamp is characterized in that a distance between the inner surface of the lighting tube and an outer surface of the cylindrical electrode is regulated such that the electric discharge develops mainly on the inner surface of the cylindrical electrode.

According to the present invention, even if a current is large and a diameter of the lighting tube is small, sputtering of the electrode can be suppressed and a consuming speed of mercury is suppressed so as to achieve a longer lifetime of the cold-cathode fluorescent lamp. A cold-cathode fluorescent lamp according to aspect 1 comprises a sealed lighting tube having a phosphor applied onto its inner surface, and a cylindrical electrode provided at an end portion of the lighting tube, the phosphor provided in the lighting tube being excited by ultraviolet radiation that is generated in the lighting tube by electric discharge to provide visible radiation. The cold-cathode fluorescent lamp is characterized in that a distance between the inner surface of the lighting tube and an outer surface of the cylindrical electrode is regulated such that the electric discharge develops mainly on the inner surface of the cylindrical electrode.

With this configuration, it is possible to suppress excessive sputtering and reduce a consuming speed of mercury, thereby achieving a longer lifetime of the cold-cathode fluorescent lamp. A cold-cathode fluorescent lamp according to aspect 2 of the present invention is characterized in that in aspect 1, the lighting tube has an inside diameter D1 of 1 to 6 mm, the cylindrical electrode has an outside diameter D2 of $D1-0.4\,[\mathrm{mm}] \leqq D2 < D1$, and a maximum lamp current is 5 mA or more.

With this configuration, an interval between the inner surface of the lighting tube and the outer surface of the cylindrical electrode can be sufficiently small to allow electric discharge to develop mainly on the inner surface of the cylindrical electrode. A cold-cathode fluorescent lamp according to aspect 3 of the present invention is characterized in that in aspect 2, the distance d between the inner surface of the lighting tube and the outer surface of the cylindrical electrode is $0 < d \leqq 0.2$ [mm].

With this configuration, even in an operating environment at a low temperature, in which the sputtering amount is larger than at a room temperature, no electric discharge moves to an interval between the inner surface of the lighting tube and the outer surface of the cylindrical electrode. Thus, it is possible to prevent sputtering from largely consuming mercury in a short period and to suppress shortening of lifetime caused by early consumption of the electrode. A cold-cathode fluorescent lamp according to aspect 4 of the present invention is characterized in that in aspect 1, the inner surface and outer surface of the cylindrical electrode are made of different materials, and the material forming the outer surface has a larger work function than that of the material forming the inner surface.

With this configuration, since electric discharge develops in the inside of the cylindrical electrode, the inside having a smaller work function, it is possible to synergistically suppress consumption of mercury that is caused by excessive sputtering, thereby achieving a longer lifetime of the cold-cathode fluorescent lamp. A cold-cathode fluorescent lamp according to aspect 5 of the present invention is characterized in that in aspect 1, an electronic emissive material is provided in the cylindrical electrode, the electronic emissive material containing a material having a smaller work function than that of a material forming the inner surface of the cylindrical electrode.

With this configuration as well, since electric discharge develops in the inside of the cylindrical electrode, the inside having a smaller work function, it is possible to synergistically suppress consumption of mercury that is caused by excessive sputtering, thereby achieving a longer lifetime of the cold-cathode fluorescent lamp.

A cold-cathode fluorescent lamp according to aspect 6 of the present invention is characterized in that in any one of aspects 1 to 4, the outer surface of the cylindrical electrode has protrusions abutting the inner surface of the lighting tube.

With this configuration, even when the cold-cathode fluorescent lamp has an ultra-small inside diameter of 1 to 6 mm, it is possible to prevent a contact between the cylindrical electrode and the inner wall of the lighting tube, thereby suppressing a local temperature increase on the outer wall of the lighting tube.

DESCRIPTION OF THE EMBODIMENTS

Referring to FIGS. 1 to 4, embodiments of the present invention will be discussed below.

(Embodiment 1)

Figure 1:
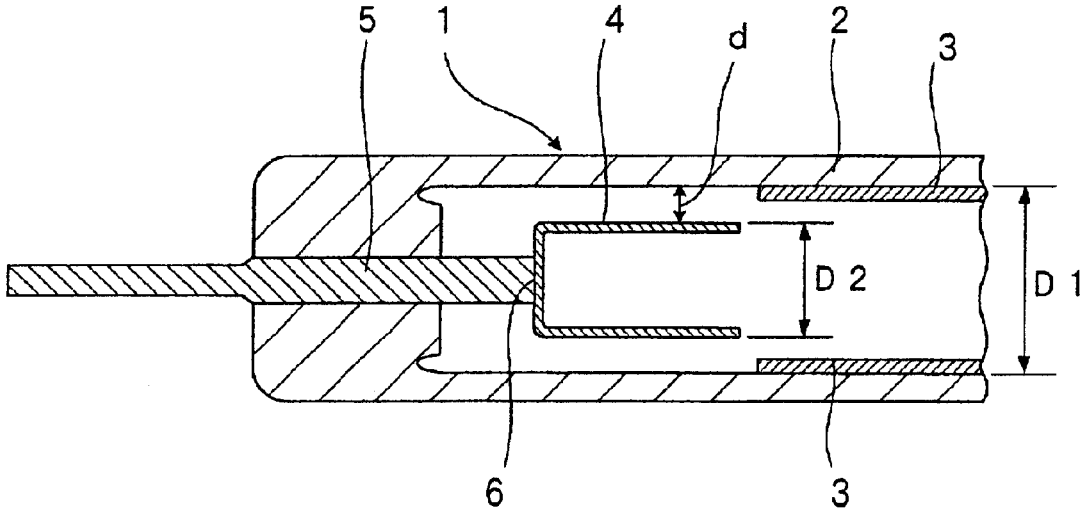
FIG. 1 shows a sectional side view of a main part of a cold-cathode fluorescent lamp according to (Embodiment 1) of the present embodiment.

FIG. 1 shows a cold-cathode fluorescent lamp according to (Embodiment 1) of the present invention.

A conductive cylindrical electrode 4 is provided via an electrode support lead 5 on an end of a lighting tube 1, in which phosphor 3 is adhered on the inner surface of a glass tube 2. An appropriate amount of mercury and rare gas are contained in the lighting tube 1, and the lighting tube 1 is sealed.

When current is applied to the cylindrical electrode 4 via the electrode support lead 5, electric discharge occurs in the lighting tube 1, and the phosphor 3 is excited by ultraviolet radiation, which is generated by the electric discharge, to provide visible radiation. Reference numeral 6 denotes a junction of the cylindrical electrode 4 and the electrode support lead 5.

In the cold-cathode fluorescent lamp configured thus, the present embodiment regulates a distance d between the inner surface of the lighting tube 1 and the outer surface of the cylindrical electrode 4 such that electric discharge develops mainly on the inner surface of the cylindrical electrode 4 and mercury in the lamp is not exhausted by a mercury trapping phenomenon caused by electrode sputtering materials when the light comes on.

To be specific, even when the lighting tube 1 has a small inside diameter D1 of 1 to 6 mm and the lamp has a relatively large current of 5 mA or more during lighting, an outside diameter D2 of the cylindrical electrode 4 is regulated according to the following equation (1) such that excessive sputtering is suppressed to perform lighting with stability. Here, the inside diameter D1 of the lighting tube 1 is equivalent to an inside diameter of the glass tube 2.

$$D1-0.4 \leqq D2 < D1 \quad (1)$$

Here, the unit of a numeric value 0.4 is [mm].

According to the above configuration, electric discharge is less prone to move to the outside of the cylindrical electrode 4 during lighting, and electric discharge develops mainly on the inner surface of the cylindrical electrode 4. Hence, it is possible to suppress excessive sputtering and to reduce a consuming speed of mercury, thereby achieving longer lifetime of the cold-cathode fluorescent lamp.

Further, when a distance d between the inner surface of the lighting tube 1 and the outer surface of the cylindrical electrode 4 is caused to satisfy the following equation (2), electric discharge can be suitably maintained during lighting. Particularly even in an operating environment at a low temperature of 0° C. or less where sputtering is intensified, concentration of electric discharge can be suppressed in an interval formed between the inner surface of the lighting tube 1 and the outer surface of the cylindrical electrode 4. Thus, it is possible to suppress a reduction of mercury that is caused by excessive sputtering, thereby achieving longer lifetime.

$$0 < d \leqq 0.2 \quad (2)$$

Here, the unit of a numeric value 0.2 is [mm].

(Embodiment 2)

Figure 2:
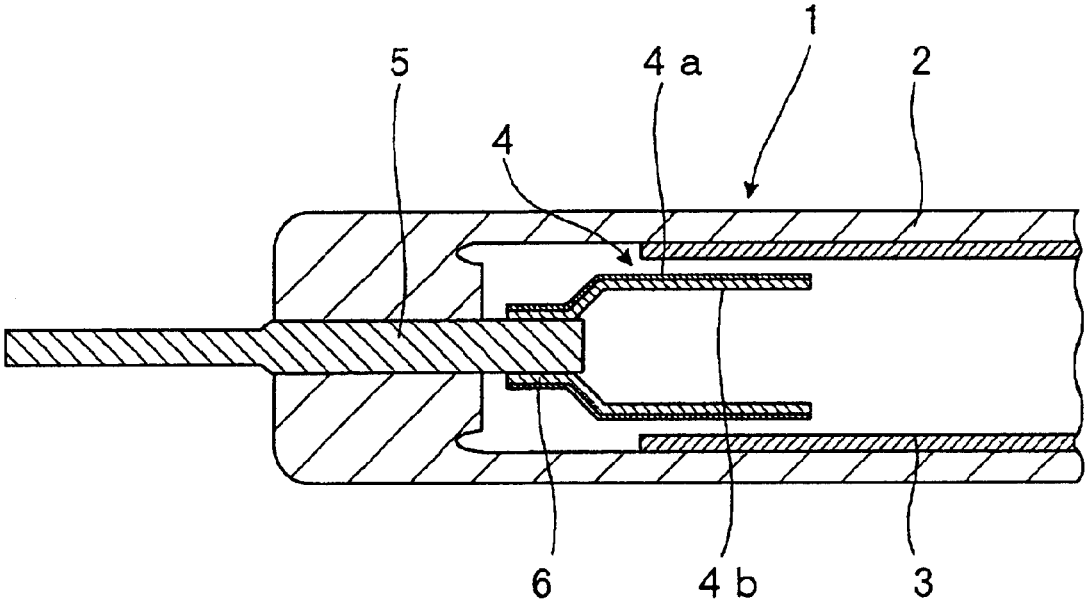
FIG. 2 shows a sectional side view of a main part of a cold-cathode fluorescent lamp according to (Embodiment 2) of the present invention.

FIG. 2 shows (Embodiment 2) of the present invention.

(Embodiment 2) is different from (Embodiment 1) in that the inner surface and outer surface of a cylindrical electrode 4 are made of different materials.

To be specific, the cylindrical electrode 4 has a dual-wall structure in which an outer side and an internal side are made of different materials. A material forming an outer layer 4*a* has a larger work function than that of a material forming an internal layer 4*b*.

As a combination of such materials, for example, the outer layer 4*a* of the cylindrical electrode 4 is made of nickel, and the internal layer 4*b* is made of a material such as titanium, niobium, and tantalum.

When the cylindrical electrode 4 configured thus is used, electric discharge during lighting concentrates on the inside of the cylindrical electrode 4, the inside having a small work function. Thus, it is possible to suppress exhaustion of mercury that is resulted from excessive electric discharge sputtering on the outside of the cylindrical electrode 4, and to suppress early exhaustion of the electrode.

Here, the outer layer 4*a* is entirely provided on the outside of the cylindrical electrode 4. The present invention is not limited to the above configuration. The same effect can be obtained as long as the outer layer 4*a* made of a material with a large work function is formed so as to cover about one fourth or more of the outer circumferential surface on the opening side of the cylinder electrode 4.

Moreover, the outer layers 4*a* and the internal layer 4*b* are not particularly limited in thickness. For example, the internal layer 4*b* may be used as substrate metal of the electrode, and the outer layer 4*a* may be used as a coating of the substrate metal.

Additionally, although the cylindrical electrode 4 has a dual-wall structure including the outer layer 4*a* and the internal layer 4*b*, the present invention is not limited to the above configuration. Two or more layers may be included as long as the outer side of the cylindrical electrode 4 is made of a material with a larger work function than the internal side.

(Embodiment 3)

Figure 3:
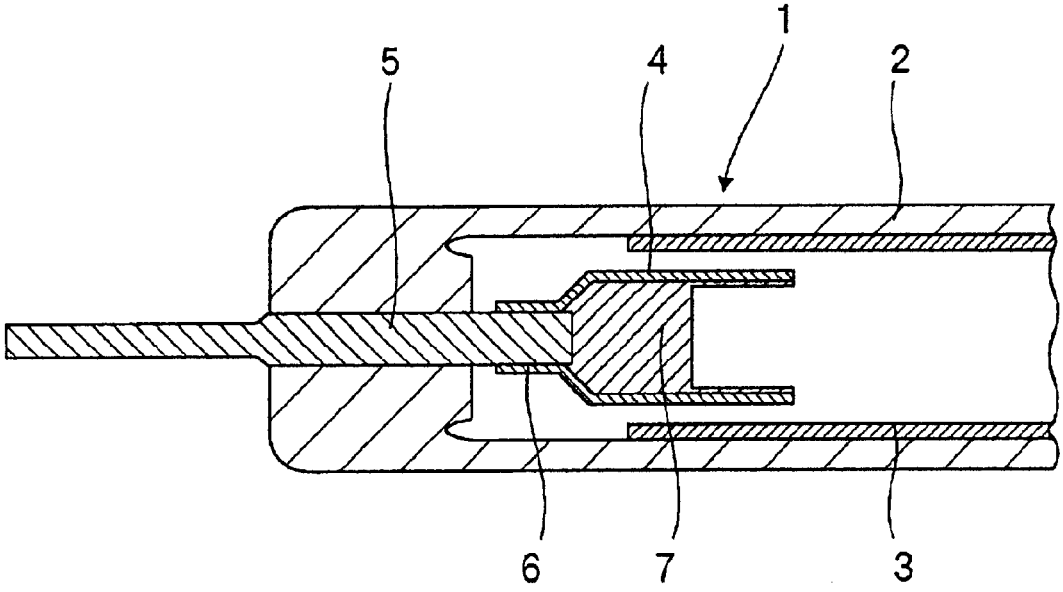
FIG. 3 shows a sectional side view of a main part of a cold-cathode fluorescent lamp according to (Embodiment 3) of the present invention.

FIG. 3 shows (Embodiment 3) of the present invention.

In the above-mentioned (Embodiment 2), the outer surface and the inner surface are made of different materials. In (Embodiment 3), on the inside of a conventional cylindrical electrode 4, a material is provided which has a smaller work function than that of the inner surface of a cylindrical electrode 4. With this configuration alone, it is possible to similarly suppress exhaustion of mercury and early exhaustion of the electrode that are resulted from excessive electric discharge sputtering.

To be specific, an electron emission material is provided in the cylindrical electrode 4. The electron emission material contains a material having a smaller work function than that of a material forming the inner surface of the cylindrical electrode 4. For example, on the inside of the cylindrical electrode 4 made of nickel, an electron emission material 7 is adhered, which is composed of oxide containing barium having a smaller work function than that of nickel.

Alkali metal such as Cs, Li, and Mg or oxide and alloy of alkaline-earth metals are applicable as the electron emission material 7.

According to the above configuration, electric discharge during lighting concentrates on the inside of the cylindrical electrode 4, the inside having a smaller work function. Thus, it is possible to suppress exhaustion of mercury and early exhaustion of the electrode that are resulted from excessive electric discharge sputtering on the outside of the cylindrical electrode 4.

(Embodiment 4)

Figure 4:
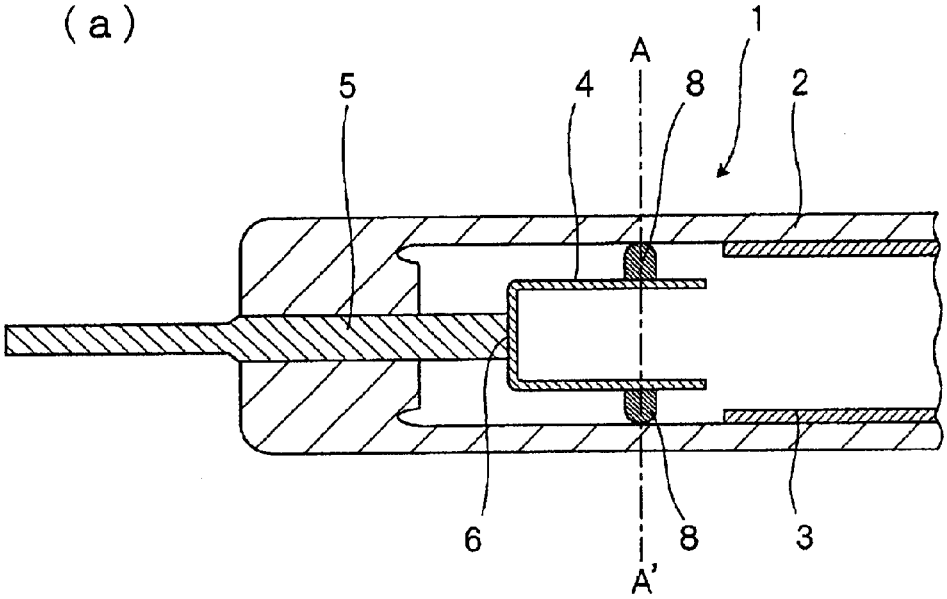
FIG. 4 shows a sectional side view of a main part of a cold-cathode fluorescent lamp according to (Embodiment 4) of the present invention, and an enlarged vertical longitudinal sectional view taken along line A–A'.
Figure 4:
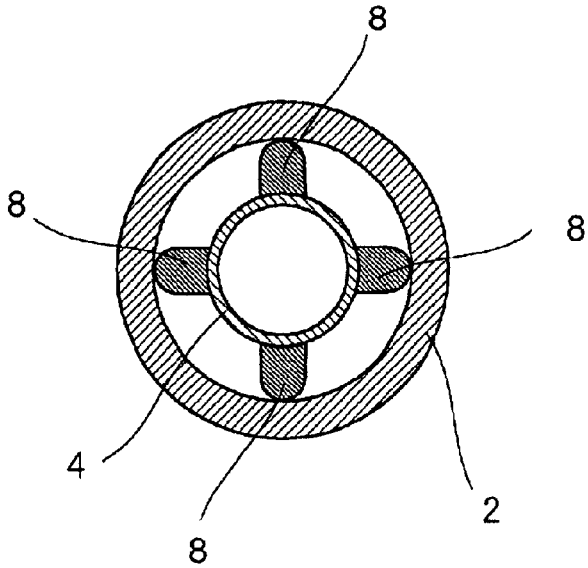

FIG. 4 shows (Embodiment 4) of the present invention.

(Embodiment 4) is different from (Embodiment 1) in that protrusions 8 abutting the inner surface of a lighting tube 1 are provided on the outer surface of a cylindrical electrode 4.

To be specific, as shown in FIG. 4(A), in a cold-cathode fluorescent lamp configured as FIG. 1, the protrusions 8 are provided, for example, at equal intervals in a circumferential direction on the outer surface of the cylindrical electrode 4 as shown in FIG. 4(B). The protrusions 8 abut the inner surface of the lighting tube 1 to position the cylindrical electrode 4 on the lighting tube 1.

When the protrusions 8 are provided in this manner, it is possible to prevent the cylindrical electrode 4 from leaning or being tilted to the end of the lighting tube 1 to abut the inner wall of the lighting tube 1, and a fixed distance can be maintained between the outer surface of the cylindrical electrode 4 and the inner surface of the lighting tube 1.

Moreover, even in the case of a cold-cathode fluorescent lamp which has an ultra-small inside diameter of 1 to 6 mm, it is possible to prevent contact between the cylindrical electrode 4 and the inner wall of the lighting tube 1 when the cylindrical electrode 4 is adhered to the end of the lighting tube 1. Thus, a local increase in temperature can be suppressed on the outer wall of the lighting tube 1.

Here, the above explanation discussed the cold-cathode fluorescent lamp of (Embodiment 1) as an example. The present invention is not limited to the above configuration but is also applicable to the cold-cathode fluorescent lamps of FIGS. 2 and 3.

Further, although the four protrusions 8 are provided in FIG. 4, the number of protrusions 8 is not particularly limited. Also, ring-shaped protrusions can achieve the same effect.

Additionally, a material not affecting electric discharge is preferably used as a material forming the protrusions 8. For example, insulating ceramic and the like is applicable.

The following will discuss specific examples of the above-mentioned embodiments.

EXPERIMENTAL EXAMPLE 1

The cold-cathode fluorescent lamp of FIG. 1 was produced according to the following steps.

On the inner surface of the glass tube 2, which was made of borosilicate glass with an inside diameter D1 of 1.6 mm, a predetermined amount of three-band type phosphor 3 with a color temperature of 5000K was adhered to form a lighting tube 1. A cylindrical electrode 4, which has a bottom and is made of a nickel material with an outside diameter D2 of 1.2 mm, an inside diameter of 0.8 mm, and a length of 5 mm, was provided on the end of the lighting tube 1.

200 $\mu$g of mercury and 8 kPa of argon-neon mixed gas were applied into the lighting tube 1 to form a cold-cathode fluorescent lamp as a trial lamp A, which had rating lamp current of 8 mA and a length of 300 mm.

Moreover, a trial lamp B was produced in the same manner as the trial lamp A except that an outside diameter D2 of the cylindrical electrode 4 was 1.0 mm.

The trial lamp A and the trial lamp B and a high-frequency inverter lighting circuit having a lighting frequency of 60 kHz were used to conduct a lighting experiment, in which a lamp current is 6 mA at room temperature.

As to the cylindrical electrode 4 used for the trial lamp A and the trial lamp B, an electrode area required for electric discharge could not be obtained on the inner surface alone of the cylindrical electrode 4. The trial lamp A had a distance between the inner surface of the lighting tube 1 and the outer surface of the cylindrical electrode 4 according to the range of the present invention. Thus, electric discharge was performed mainly on the inner surface of the cylindrical electrode 4, and substantially perfect hollow effect was obtained in a hollow structure. In this manner, when electric discharge was performed on the inner surface of the cylindrical electrode 4, generated sputtering materials were adhered to the inner surface of the electrode again and were reused thereon so as to suppress the occurrence of electrode sputtering. Hence, an amount of consumed mercury was reduced to about one tenth of that of the trial lamp B, and target lifetime of 30,000 hours was satisfied without any trouble.

Here, in the hollow effect, electrons are emitted from an electrode when the electrode is formed into a cylinder, the electrons collide with an opposing surface and heats the surface, and the electrons returned to the neighborhood of the original surface by reflection, so that an electron discharging rate is improved. An electrode structure for obtaining such an effect is referred to as a hollow structure.

Meanwhile, the trial lamp B had a wider interval between the inner surface of the lighting tube 1 and the outer surface of the cylindrical electrode 4 as compared with the range of the present invention. Thus, electric discharge occurred on the outer surface of the cylindrical electrode 4 as well, a perfect hollow effect was not obtained, mercury in the lamp was completely exhausted at 15,000 hours, which was earlier than target lifetime of 30,000 hours, due to mercury trapping phenomenon caused by electrode sputtering materials, and a luminance of the lamp was lowered to 50% or less of an initial luminance.

Based on the above experimental results, experiments were conducted while an inside diameter D1 of the lighting tube 1 and an outside diameter D2 of the cylindrical electrode 4 were varied. It was confirmed that in the case where the inside diameter D1 of the lighting tube 1 was 1 to 6 mm, when the outside diameter D2 [mm] of the cylindrical electrode 4 satisfied the above-mentioned equation (1), electric discharge did not expand to the outer circumferential surface of the cylindrical electrode 4, thereby sufficiently achieving the effect of a hollow electrode. Further, it was found that the cylindrical electrode 4 did not abut the inner surface of the glass tube 2, resulting in no temperature increase on the outer surface of the glass tube 2 corresponding to an electrode part, so that the lamp was suitable for practical use.

Additionally, when the outside diameter D2 of the cylindrical electrode 4 was (D−0.4) or less, electric discharge expanded to the outer circumferential surface of the cylindrical electrode 4, electrode sputtering materials were increased, and an amount of consumed mercury was increased. Thus, the lamp could not obtain target lifetime. Further, when the inside diameter D1 of the glass tube 2 was equal to the outside diameter D2 of the cylindrical electrode 4, the cylindrical electrode 4 abutted the inner surface of the glass tube 2. Hence, a temperature rose on the outer surface of the glass tube 2 corresponding to the electrode part, so that the lamp was not suitable for practical use.

EXPERIMENTAL EXAMPLE 2

Next, as to a cold-cathode fluorescent lamp in which a lighting tube 1 had a small inside diameter D1 of 1 to 6 mm and an inverter of a sin wave output waveform had a lamp current of 5 mA or more, the following experiment was conducted to find optimum design conditions of a cylindrical electrode 4.

First, in the cold-cathode fluorescent lamp in which a glass tube 2 for forming the lighting tube 1 had an inside diameter D1 of 1.4 mm and the cylindrical electrode 4 had an outside diameter D2 of 1.0 mm, an inside diameter of 0.8 mm, and a length of 3 mm, a trial lamp C was produced while a distance d between the internal surface of the lighting tube 1 and the outer surface of the cylindrical electrode 4 was fixed at 0.2 mm.

Further, a trial lamp D was produced in which a cylindrical electrode 4 was tilted and a distance d between the internal surface of a lighting tube 1 and the outer surface of the cylindrical electrode 4 was set at 0.35 to 0.05 mm.

The produced trial lamps C and D were used to conduct a lighting experiment in an operating environment at ambient temperature of 0° C.

The trial lamp C did not cause any practical problem of an amount of consumed mercury. Meanwhile, the trial lamp D of (Comparative Example 2) could obtain target lifetime despite an increase in consumption of mercury. However, electric discharge concentrated on the side having a wider interval between the internal surface of the lighting tube 1 and the outer surface of the cylindrical electrode 4, and a temperature increased on the outer surface of the lighting tube 1.

According to the above result, it was found that an improving effect on practical use was obtained as follows: when a distance d between the internal surface of the lighting tube 1 and the outer surface of the cylindrical electrode 4 satisfied the above-mentioned equation (2), consumption of mercury was sufficiently suppressed and concentration of electric discharge on the side of a wider interval was suppressed, so that a temperature increase is suppressed on the outer surface of the lighting tube 1.

EXPERIMENTAL EXAMPLE 3

As shown in FIG. 2, a cylindrical electrode 4 was produced, in which an outer side 4*a* was made of nickel so as to a have larger work function than that of an internal side 4*b*, and the internal side 4*b* was made of a material such as titanium, tantalum, niobium, and an alloy thereof so as to have a larger work function than that of nickel. A trial lamp E was produced in the same manner as the trial lamp A except for the above-mentioned configuration.

Further, a trial lamp F was produced, in which a cylindrical electrode 4 of the trial lamp E had reversed materials of an outer side 4*a* and an internal side 4*b* of the cylindrical electrode 4.

The trial lamp E and the trial lamp F and a high-frequency inverter lighting circuit having a lighting frequency of 60 kHz were used to conduct a lighting experiment while a lamp current was set at 6 mA in an operating environment at ambient temperature of 0° C.

In the trial lamp E, electric discharge occurred mainly on the inner surface of the cylindrical electrode 4, the inner surface having a large work function, and electric discharge expanding to the outer surface was reduced. Thus, an amount of electrode sputtering was suppressed and consumption of mercury was reduced.

Meanwhile, in the trial lamp F, electric discharge occurred only on the outer surface of the cylindrical electrode, the outer side having a small work function, resulting in small electric discharge entering the inner surface due to hollow effect. Hence, an amount of electrode sputtering was increased and consumption of mercury was also increased.

In this manner, it was found that when the outer side 4*a* of the cylindrical electrode 4 was made of a material having a larger work function than the internal side 4*b*, a great advantage on practical use was further obtained in addition to that of the trial lamp A.

Besides, the above-mentioned (Experimental Example 3) discussed an example in which the outer side of the cylindrical electrode 4 was entirely made of an outer material 4*a*. It was confirmed that the same effect could be obtained as long as the outer material 4*a* covered about one fourth or more of the outer circumferential surface on the opening side of the cylindrical electrode 4.

EXPERIMENTAL EXAMPLE 4

As shown in FIG. 3, a trial lamp G was produced, in which an electronic emissive material containing barium oxide was provided as an electronic emissive material containing a material having a smaller work function than nickel. The electronic emissive material was provided in the cylindrical electrode 4 made of nickel in the trial lamp A, which was produced in (Experimental Example 1).

When the trial lamp G was used to conduct the same lighting experiment, an improving effect on practical use was confirmed as follows: electric discharge only entered the inner surface of the cylindrical electrode 4 and caused no electric discharge on the outer surface, an amount of electrode sputtering was suppressed, and consumption of mercury was reduced.

EXPERIMENTAL EXAMPLE 5

Means was studied for preventing a cylindrical electrode 4 from being tilted and fixed when the cylindrical electrode 4 was adhered to an end of a lighting tube 1, which used a glass tube 2 having a small inside diameter D1 of 1 to 6 mm.

As shown in FIG. 4, on the outer surface around the end of the cylindrical electrode 4 in the trial lamp A, which was produced in (Experimental Example 1), protrusions 8 made of ceramic were provided on two places. The protrusions 8 were disposed at equal intervals in a circumferential direction and abutted the inner surface of the lighting tube 1.

The above cylindrical electrode 4 was mounted in the lighting tube 1 configured as (Experimental Example 1) to form a trial lamp H. In the trial lamp H, the cylindrical electrode 4 was disposed on a suitable position and was adhered to the end of the glass tube 2. Further, since ceramic had low thermal conductivity, temperature did not locally increase on a part where an electrode and glass abut each other on the outer surface of glass during lighting, or lifetime was not shortened by consumption of mercury. Moreover, it was confirmed that when the protrusions 8 were provided on two or more places, the cylindrical electrode 4 could be mounted in the lighting tube 1 with stability.

Additionally, the above-mentioned embodiments and experimental examples discussed an example in which the cylindrical glass tube 2 with a bottom is used as the cylindrical electrode 4. The present invention is not limited to the above configuration. The bottom may be omitted, the outside of the cylindrical electrode 4 may be made of an insulating material, and an oxidized coating may be formed on the outside of the cylindrical electrode 4.

Additionally, the size, design, material, shape, rating and so on of the cold-cathode fluorescent lamp are not limited to the above.

As described above, according to the cold-cathode fluorescent lamp of the present invention, a cylindrical electrode is provided on the end of a lighting tube, which is sealed and has phosphor applied therein, and the phosphor provided in the lighting tube is excited by ultraviolet radiation generated by electric discharge in the lighting tube, so that visible radiation is obtained. A distance between the inner surface of the lighting tube and the outer surface of the cylindrical electrode is regulated such that the electric discharge develops mainly on the inner surface of the cylindrical electrode. Thus, excessive sputtering can be suppressed to reduce a consuming speed of mercury, resulting in longer lifetime of the cold-cathode fluorescent lamp.

Particularly, even when the lighting tube 1 has a small inside diameter D1 of 1 to 6 mm and a large maximum lamp current of 5 mA, since an outside diameter D2 of the cylindrical electrode is at $D1-0.4 \leqq D2 < D1$, it is possible to minimize consumption of mercury that is caused by increased electric discharge sputtering and to reduce consumption of the electrode, thereby achieving longer lifetime. Consequently, an improving effect on practical use can be further obtained.

What is claimed is:

1. A cold-cathode fluorescent lamp, comprising:

a sealed lighting tube having phosphor on an inner surface thereof; and a hollow cylindrical electrode having an inner surface located at an end portion of the lighting tube, wherein the phosphor is for providing visible radiation upon being excited by ultraviolet radiation generated by electric discharge inside the lighting tube, a distance between the inner surface of the lighting tube and an outer surface of the hollow cylindrical electrode is such that an electric discharge develops mainly on the inner surface of the hollow cylindrical electrode, the lighting tube has an inside diameter D1 of 1 to 6 mm, the hollow cylindrical electrode has an outside diameter D2 of $D1 - 0.4\ \text{mm} \leqq D2 < D1$, and a maximum lamp current is 5 mA or more, and the distance d between the inner surface of the lighting tube and the outer surface of the hollow cylindrical electrode is defined by the relationship $0 < d \leqq 0.2$ mm.

2. The cold-cathode fluorescent lamp according to claim 1, wherein the inner surface and outer surface of the hollow cylindrical electrode are made of different materials, and the material forning the outer surface has a larger work function than that of the material forming the inner surface of the hollow cylindrical electrode.

3. The cold-cathode fluorescent lamp according to claim 1, further comprising an electron emission material inside the hollow cylindrical electrode, the electron emission material comprising a material having a smaller work function than that of the material forming the outer surface of the hollow cylindrical electrode.

4. A cold-cathode fluorescent lamp comprising:

a sealed lighting tube having phosphor on an inner surface thereof; and a hollow cylindrical electrode having an inner surface located at an end portion of the lighting tube, wherein:

the phosphor is for providing visible radiation upon being excited by ultraviolet radiation generated by electric discharge inside the lighting tube, a distance between the inner surface of the lighting tube and an outer surface of the hollow cylindrical electrode is such that an electric discharge develops mainly on the inner surface of the hollow cylindrical electrode, and the outer surface of the hollow cylindrical electrode has protrusions abutting the inner surface of the lighting tube.

5. The cold-cathode fluorescent lamp according to claim 4, wherein the lighting tube has an inside diameter D1 of 1 to 6 mm, the hollow cylindrical electrode has an outside diameter D2 of $D1-0.4\ \text{mm} \leqq D2 < D1$.

6. The cold-cathode fluorescent lamp according to claim 4, wherein the distance d between the inner surface of the lighting tube and the outer surface of the hollow cylindrical electrode is defined by the relationship $0 < d \leqq 0.2$ mm.

7. The cold-cathode fluorescent lamp according to claim 4, wherein the inner surface and outer surface of hollow cylindrical electrode are made of different materials, and the material forming the outer surface has a larger work function than that of the material forming the inner surface of the hollow cylindrical electrode.

8. The cold-cathode fluorescent lamp according to claim 4, further comprising an electron emission material inside the hollow cylindrical electrode, the electron emission material containing a material having a smaller work function than that of the material forming the outer surface of the hollow cylindrical electrode.

* * * * *